US008914930B2

(12) United States Patent
Chanda et al.

(10) Patent No.: US 8,914,930 B2
(45) Date of Patent: Dec. 23, 2014

(54) LAUNDRY TREATING APPLIANCE WITH LOAD AMOUNT DETECTION

(75) Inventors: Hirak Chanda, Saint Joseph, MI (US); Michael L. Jackemeyer, Buchanan, MI (US); Christoph J. Miller, Saint Joseph, MI (US); James A. Oskins, Saint Joseph, MI (US); Andre Petronilho, Rio Clara (BR); Robert A. Scheitlin, Saint Joseph, MI (US); Jon D. Strait, Saint Joseph, MI (US); Matthew S. Wasson, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 328 days.

(21) Appl. No.: 13/084,625

(22) Filed: Apr. 12, 2011

(65) Prior Publication Data

US 2011/0247148 A1 Oct. 13, 2011

Related U.S. Application Data

(60) Provisional application No. 61/323,674, filed on Apr. 13, 2010.

(51) Int. Cl.

| | |
|---|---|
| ***D06F 35/00*** | (2006.01) |
| ***D06F 33/02*** | (2006.01) |
| ***D06F 39/00*** | (2006.01) |

(52) U.S. Cl.

CPC ..... *D06F 39/003* (2013.01); *D06F 33/02* (2013.01); *D06F 2202/12* (2013.01); *D06F 2202/065* (2013.01)

USPC ..... 8/158; 68/12.04

(58) Field of Classification Search

CPC ..... D06F 39/003

USPC ..... 8/158, 159; 68/12.04

See application file for complete search history.

(56) References Cited

U.S. PATENT DOCUMENTS

| | | | | |
|---|---|---|---|---|
| 4,235,085 | A | | 11/1980 | Torita |
| 4,862,710 | A | | 9/1989 | Torita et al. |
| 5,058,401 | A | * | 10/1991 | Nakamura et al. ..... 68/19.2 |
| 5,208,931 | A | | 5/1993 | Williams et al. |
| 5,507,054 | A | | 4/1996 | Blauert et al. |
| 5,577,283 | A | | 11/1996 | Badami et al. |
| 5,768,728 | A | | 6/1998 | Harwood et al. |
| 6,446,291 | B1 | | 9/2002 | Diaz Fernandez et al. |
| 6,505,369 | B1 | | 1/2003 | Weinmann |
| 6,550,290 | B2 | | 4/2003 | Shimakage et al. |

(Continued)

FOREIGN PATENT DOCUMENTS

| | | |
|---|---|---|
| DE | 4122307 A1 | 1/1993 |
| DE | 4204046 A1 | 8/1993 |

(Continued)

OTHER PUBLICATIONS

German Search Report for corresponding DE102011002015, Nov. 25, 2011.

*Primary Examiner* — David Cormier

(57) ABSTRACT

A method and apparatus determines a load size of a laundry load located in a laundry treating appliance having a drum defining a treatment chamber that is rotated by a motor based on a given amount of energy applied to the motor, and a measurement of coast time after the given amount of energy is removed.

16 Claims, 3 Drawing Sheets

(56) References Cited

U.S. PATENT DOCUMENTS

| | | | | |
|---|---|---|---|---|
| 6,842,928 | B2 | 1/2005 | Yang et al. | |
| 7,299,515 | B2 | 11/2007 | Oh et al. | |
| 7,555,798 | B2 | 7/2009 | Kim et al. | |
| 2005/0028299 | A1 | 2/2005 | Jeon et al. | |
| 2005/0050646 | A1 | 3/2005 | Lee et al. | |
| 2005/0086742 | A1 | 4/2005 | Kim et al. | |
| 2005/0166644 | A1* | 8/2005 | France et al. | 68/12.04 |
| 2008/0041115 | A1* | 2/2008 | Kanazawa et al. | 68/12.04 |
| 2009/0250377 | A1 | 10/2009 | Chun et al. | |

FOREIGN PATENT DOCUMENTS

| | | | |
|---|---|---|---|
| EP | 0536542 | A1 | 4/1993 |
| EP | 0704568 | A1 | 4/1996 |
| GB | 2325245 | A | 11/1998 |
| WO | 2008/003710 | A1 | 1/2008 |

* cited by examiner

LAUNDRY TREATING APPLIANCE WITH LOAD AMOUNT DETECTION

CROSS-REFERENCE TO RELATED APPLICATION

This application claims the benefit of U.S. Provisional Application Ser. No. 61/323,674, filed on Apr. 13, 2010, which is incorporated herein by reference in its entirety.

BACKGROUND OF THE INVENTION

Laundry treating appliances, such as clothes washers, clothes dryers, refreshers, and non-aqueous systems, may have a configuration based on a rotating drum that defines a treating chamber in which laundry items are placed for treating. The laundry treating appliance may have a controller that implements a number of pre-programmed cycles of operation. The user typically manually selects the cycle of operation from the given pre-programmed cycles. Each pre-programmed cycle may have any number of adjustable parameters, which may be input by the user or may be set by the controller. The controller may set the parameter according to default values, predetermined values, or responsive to conditions within the treating chamber.

It is known to measure the mass of a load of laundry in a clothes washer by changing the rotational speed of a motor-driven drum containing the load, and measuring parameters associated with the speed. For example, it is known to accelerate a drum to a predetermined rotational speed, remove power from the motor, measure the time it takes the drum to coast to a stop, and use time and energy values to achieve the predetermined speed to calculate a load mass. Accuracy of the calculation is affected by such things as machine variations, temperature, friction, motor stall, imbalance effects, power fluctuations, and current and voltage sensing errors

SUMMARY OF THE INVENTION

One embodiment of the invention relates to a method of operating a laundry treating appliance having a rotatable drum defining a treating chamber for holding laundry for treatment according to an automatic cycle of operation and driven by a variable speed motor, the method includes determining a first rotational speed of the variable speed motor, applying a predetermined amount of energy to the variable speed motor to accelerate the rotation of the drum, removing the predetermined amount of energy from the variable speed motor, determining a coast time for the variable speed motor to return to the first rotational speed, and determining a load size of the laundry load within the treating chamber based on the predetermined amount of energy and the determined coast time.

Another embodiment of the invention relates to a laundry treating appliance configured to treat a load of laundry according to a cycle of operation, including a rotatable treating chamber configured to receive a load of laundry, a variable speed motor operably coupled to the treating chamber to rotate the treating chamber, a motor speed sensor configured to sense a rotational speed of the motor and provide an output indicative thereof, and a controller operably coupled with the motor and the motor speed sensor and configured to receive the output from the motor speed sensor, determine a rotational speed of the motor based on the output, determine a first rotational speed of the motor, add a known amount of energy to the motor, determine a coast time in which it takes the motor to return to the first rotational speed, and determine a load size of the laundry load within the treating chamber based on the known amount of energy and the determined coast time.

DESCRIPTION OF EMBODIMENTS OF THE INVENTION

Figure 1:
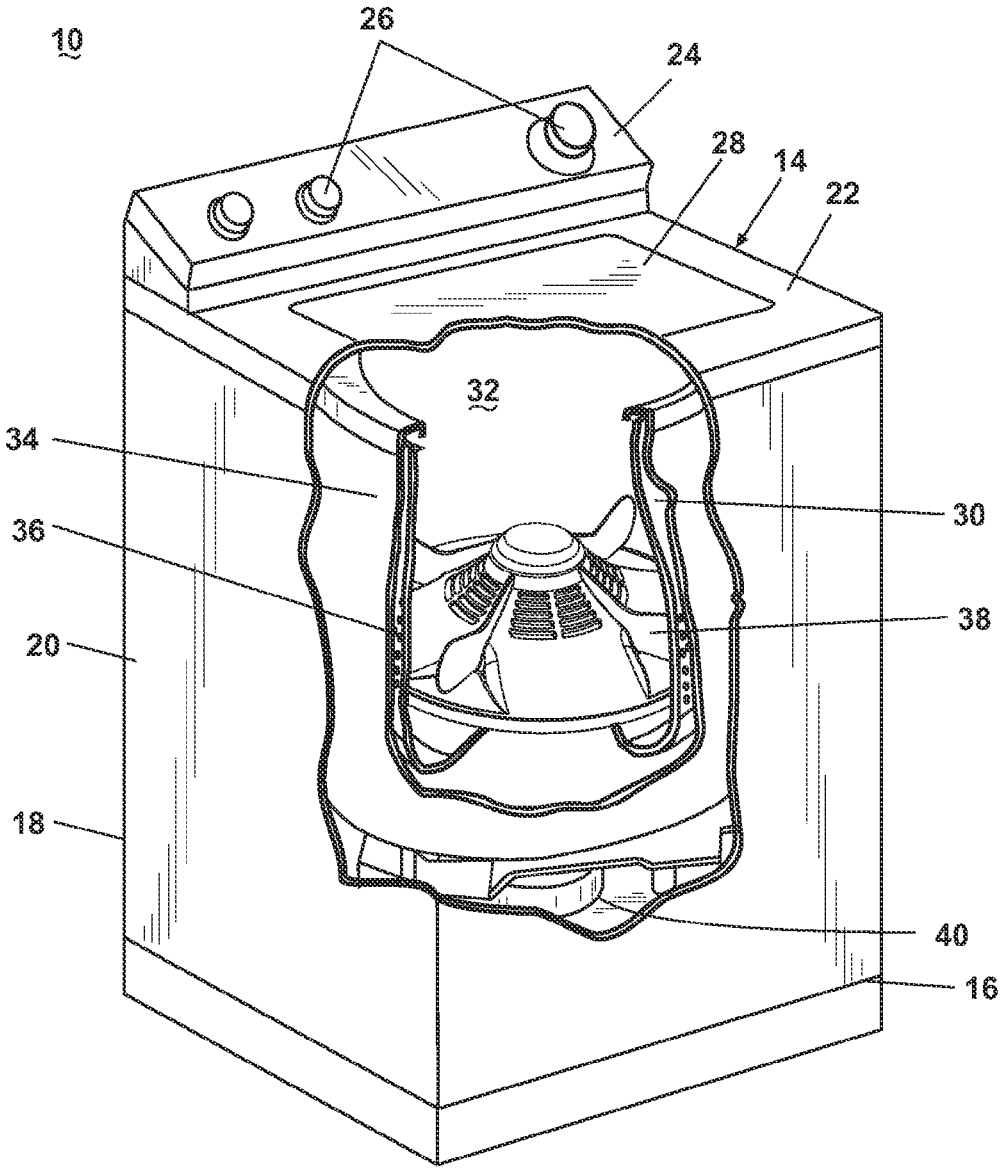
FIG. 1 is a perspective view of a laundry treating appliance which can perform a method of determining load amount according to one embodiment of the invention, with a portion cut-away to show interior components of the laundry treating appliance.

FIG. 1 is a perspective view of a laundry treating appliance 10 in the form of a washing machine according to one embodiment of the invention. Although described herein in terms of a washing machine 10 described below and shown in the drawings, it will be understood that the invention is not so limited, but is applicable to any suitable laundry treating appliance. As illustrated, the laundry treating appliance 10 is a vertical-axis washing machine; however, the laundry treating appliance 10 may be any appliance which performs a cycle of operation on laundry, non-limiting examples of which include a horizontal-axis washing machine; a horizontal or vertical axis clothes dryer; a combination washing machine and clothes dryer; a tumbling or stationary refreshing/revitalizing machine; an extractor; a non-aqueous washing apparatus; and a revitalizing machine. As used herein, the term "vertical-axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis washing machine, the term "horizontal-axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination. The laundry treating appliance 10 described herein shares many features of a traditional automatic washing machine, which will not be described in detail except as necessary for a complete understanding of the invention. For illustrative purposes, the method will be described with respect to a washing machine with one or more articles making up the load, with it being understood that the invention may be adapted for use with other types of laundry treating appliances.

As illustrated in FIG. 1, the laundry treating appliance 10 may have a cabinet 14 defined by a front wall 16, a rear wall 18, and a pair of side walls 20 supporting a top wall 22. A user interface 24 on the cabinet 14 has multiple controls 26, which a user can select to operate the laundry treating appliance 10 through the steps of a wash cycle. A chassis (not shown) may be provided, with the walls mounted to the chassis.

The top wall 22 may have an openable door or lid 28 and may be selectively moveable between opened and closed positions to close an opening in the top wall 22, which provides access to the interior of the cabinet 14. A rotatable drum 30 may be disposed within the interior of the cabinet 14 and defines a treating chamber 32 for treating laundry. The drum 30 may be positioned within an imperforate tub 34. The drum 30 may include a plurality of perforations 36, such that liquid may flow between the tub 34 and the drum 30 through the perforations 36. A clothes mover 38 may be located in the drum 30 to impart mechanical agitation to a load of clothing articles placed in the drum 30.

The drum 30 and/or the clothes mover 38 may be driven by an electrical motor 40 operably connected to the drum 30 and/or the clothes mover 38. The clothes mover 38 may be oscillated or rotated about its axis of rotation during a cycle of operation in order to produce high water turbulence effective to wash the load contained within the treating chamber 32. The motor 40 may rotate the drum 30 at various speeds in either rotational direction.

While the illustrated laundry treating appliance 10 includes both the tub 34 and the drum 30, with the drum 30 defining the laundry treatment chamber 32, it is within the scope of the invention for the laundry treating appliance to include only one receptacle, with the receptacle defining the laundry treatment chamber for receiving the load to be treated.

Figure 2:
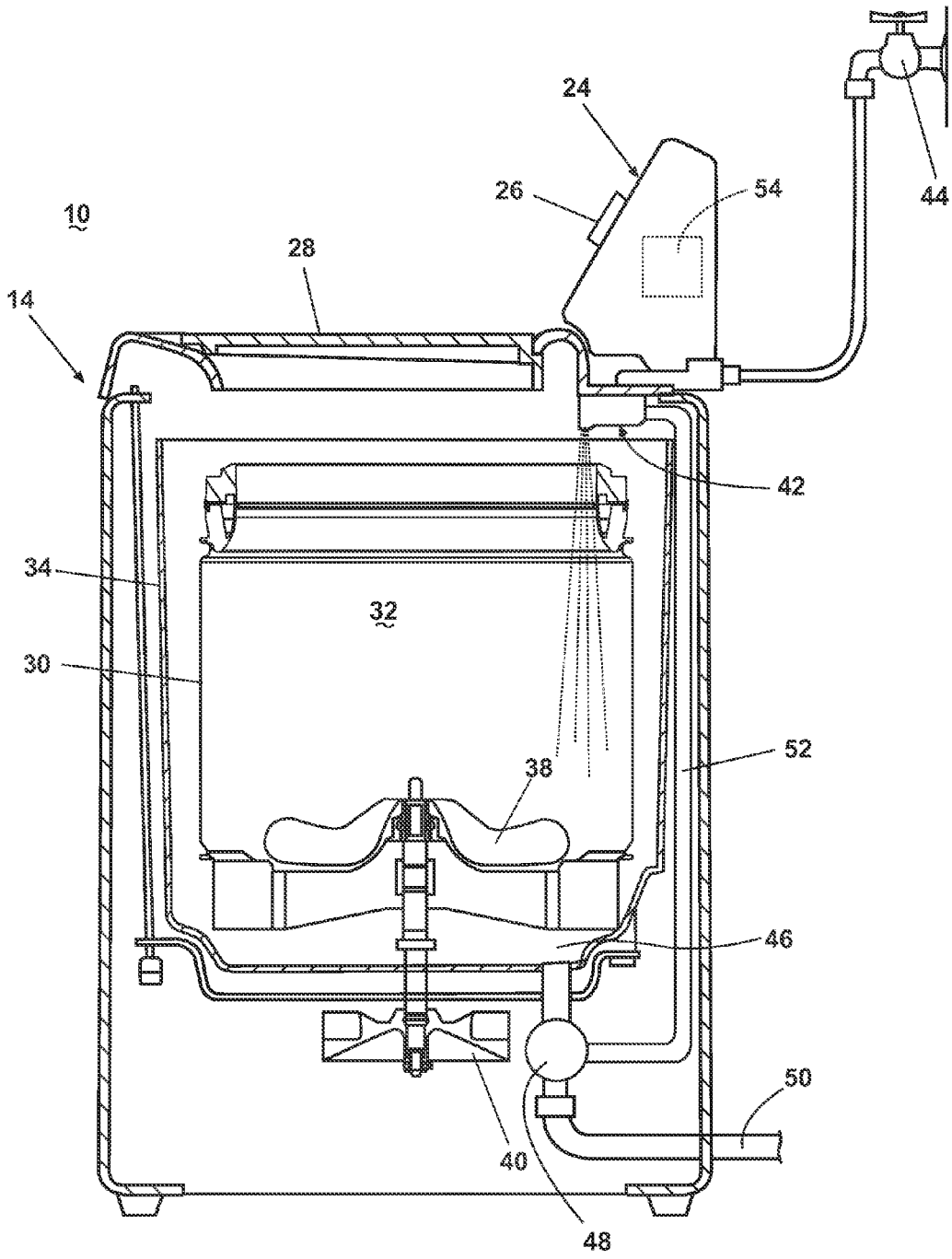
FIG. 2 is a schematic cross-sectional view of the interior components of the laundry treating appliance of FIG. 1.

FIG. 2 is a schematic cross-sectional view of the interior components of the laundry treating appliance of FIG. 1. A liquid supply and recirculation system 42 may be provided to spray treating liquid, such as water or a combination of water and one or more wash aids, such as detergent, into the open top of the drum 30 and onto the top of a laundry load placed within the treating chamber 32. The liquid supply and recirculation system 42 may be configured to supply treating liquid directly from a household water supply 44 and/or from the tub 34 and spray it onto the fabric load. The liquid supply and recirculation system 42 may also be configured to recirculate treating liquid from the tub 34, including a sump 46, and spray it onto the top of the load. A pump 48 may be housed below the tub 34. The pump 48 may have an inlet fluidly coupled to the sump 46 and an outlet configured to fluidly couple to either or both a household drain 50 or a recirculation conduit 52. In this configuration, the pump 48 may be used to drain or recirculate wash water in the sump 46, which is initially sprayed into the drum 30, flows through the drum 30, and then into the sump 46.

Additionally, the liquid supply and recirculation system 42 may differ from the configuration shown in FIG. 2, such as by inclusion of other valves, conduits, wash aid dispensers, heaters, sensors, such as water level sensors and temperature sensors, and the like, to control the flow of treating liquid through the laundry treating appliance 10 and for the introduction of more than one type of detergent/wash aid. Further, the liquid supply and recirculation system 46 need not include the recirculation portion of the system or may include other types of recirculation systems.

The laundry treating appliance 10 may further comprise a controller 54 coupled to various working components of the laundry treating appliance 10, such as the motor 40 and the pump 48, to control the operation of the working components. The controller 54 may receive data from one or more of the working components and may provide commands, which can be based on the received data, to one or more of the working components to execute a desired operation of the laundry treating appliance 10. The commands may be data and/or an electrical signal without data. The user interface 24 may be coupled to the controller 54 and may provide for input/output to/from the controller 54. In other words, the user interface 24 may allow a user to enter input related to the operation of the laundry treating appliance 10, such as selection and/or modification of an operation cycle of the laundry treating appliance 10, and receive output related to the operation of the laundry treating appliance 10.

Many known types of controllers may be used for the controller 54. The specific type of controller is not germane to the invention. It is contemplated that the controller 54 may be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

The laundry treating appliance 10 may perform one or more manual or automatic treating cycles or cycle of operation, and a common treating cycle includes a wash phase, a rinse phase, and a spin extraction phase. Other phases for treating cycles include, but are not limited to, intermediate extraction phases, such as between the wash and rinse phases, and a pre-wash phase preceding the wash phase, and some treating cycles include only a select one or more of these exemplary phases. Regardless of the phases employed in the treating cycle, the method described below may relate to determining the amount of load of laundry placed in the treating chamber 32 for a treating cycle, and includes determining the amount of load either dry (before the addition of water into the treatment chamber) or wet (after the addition of water into the treatment chamber).

The previously described laundry treating appliance 10 provides the structure necessary for the implementation of the methods of the invention. One embodiment of the method will now be described in terms of the operation of the laundry treating appliance 10. The method functions to determine the amount of the laundry load, and may control the operation of the laundry treating appliance 10 based on the determined load amount.

The amount of the laundry load in the treating chamber 32 may be determined by operating the motor 40 at a first rotational speed R1, adding a known amount of energy to the motor 40 to increase or accelerate the rotational speed of the motor 40 to a second rotational speed R2, which is typically greater than the first rotational speed R1, removing the added known energy from the motor, and measuring the amount of time t, or coast time t, it takes for the motor 40 to return or decelerate to the first rotational speed R1. The load amount can be determined from the coast time t, using well-known methods for such determination. The amount of time t it takes for the motor 40 to decelerate from the variable second rotational speed R2 to the constant first rotational speed R1 may be considered a "coast time", since no energy is being applied to the motor 40.

The first rotational speed R1 and amount of energy are both constant values in that they are predetermined and measurable, regardless of the load amount, and the second rotational speed R2 and coast time t will vary according to the load amount. For example, applying a fixed amount of energy to the motor 40 to rotate the drum 30 containing a heavier load will result in the drum 30 reaching a slower second rotational speed R2 compared to a second rotational speed R2 reached by a drum 30 containing a lighter load. In general, the coast time t for the motor 40, i.e. the amount of time for the motor 40 to slow down from the variable second rotational speed R2 to the constant first rotational speed R1, will decrease as the load amount increases. Therefore, the coast time t can be correlated to load amount.

The rotational speed of the motor 40 can be determined by sensors coupled to the controller 54. In one configuration of the method, the first rotational speed R1 can be zero revolutions per minute (rpm). In another configuration of the method, the first rotational speed R1 can be approximately equal to the lowest detectable speed by the laundry treating appliance 10. In other configurations, the first rotational speed R1 can be any known speed in a given cycle. The first rotational speed R1 can be stored by the controller 54. In general, the second rotational speed R2 does not have to be determined or measured, since only coast time t is used in the load amount determination.

Adding a known amount of energy can include adding a predetermined amount of energy to the motor 40. The predetermined amount of energy can be stored by the controller 54. Adding energy to the motor 40 can include estimating the amount of energy that has been added to the motor 40 to determine when energy application should cease.

Energy may be applied to the motor 40 by supplying power to the motor 40. Specifically, a voltage can be applied to the motor 40 to power it. The amount of power supplied to the motor is a function of current and time; therefore, the energy applied to the motor 40 can be determined by applying a given amount of voltage or current to the motor 40 for a given amount of time. A voltage sensor and/or a current sensor (not shown) may be provided for monitoring the amount of voltage or current applied to the motor 40 and may be coupled to the controller 54. Once the given amount of time has been reached, voltage/current supply to the motor 40 may be ceased by the controller 54, and the added energy calculated and its value stored.

Figure 3:
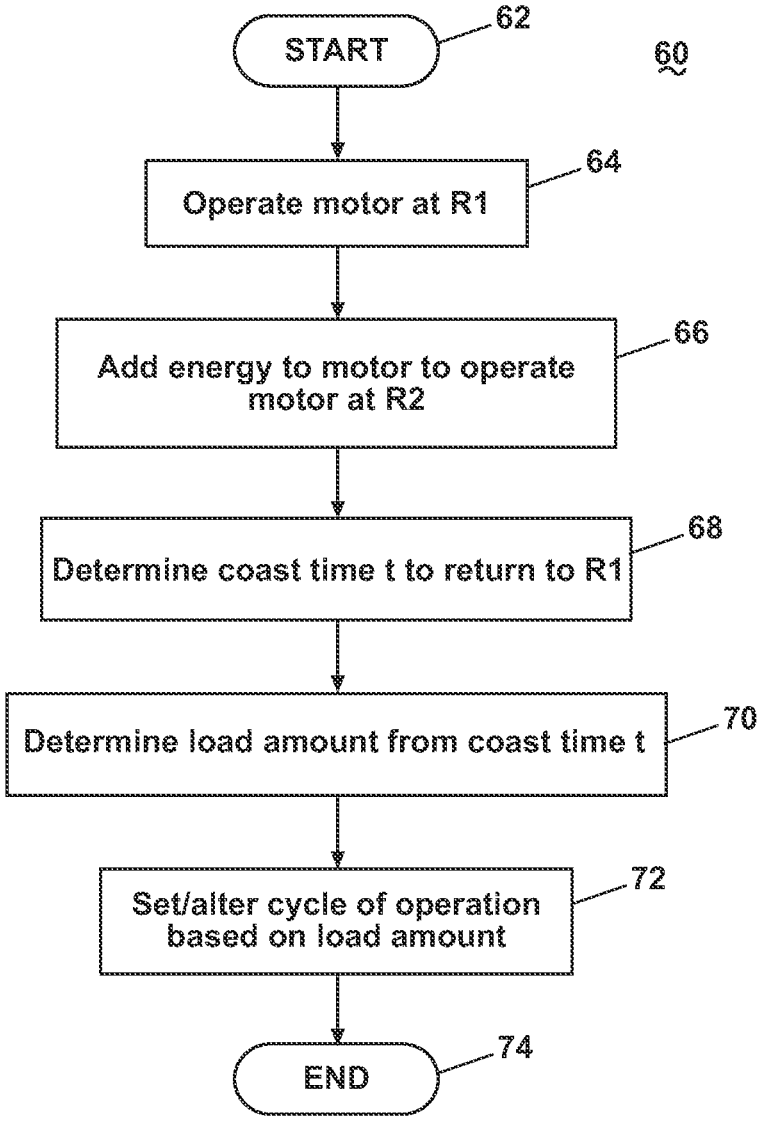
FIG. 3 is a flow-chart depicting the method of determining load amount according to one embodiment of the invention.

FIG. 3 provides a flow chart of an embodiment of a method 60 to determine the amount of the laundry load. The method 60 may be executed by the controller 54 during any cycle of operation of the laundry treating appliance 10. The sequence of steps depicted is for illustrative purposes only and is not meant to limit the method 60 in any way as it is understood that the steps may proceed in a different logical order, additional or intervening steps may be included, or described steps may be divided into multiple steps, without detracting from the invention.

Generally, in normal operation of the laundry treating appliance 10, a user first selects an appropriate treating cycle via the user interface 24. Non-limiting examples of cycles of operation include normal, delicate, and heavy-duty. The user-selection may occur prior to the start of the method 60.

At 62, the method 60 may start when the laundry load is placed in the treating chamber 32 of the laundry treating appliance 10. The method 60 may be initiated automatically when the user closes the lid 28, or at the start of the user-selected treating cycle. At 64, the first rotational speed R1 is initiated and measured. It may include ascertaining a zero speed of rotation, or operation of the motor 40 to achieve a first rotational speed R1 above zero. At 66, a known amount of energy is added to the motor 40 as described above. The added energy will accelerate the speed of the motor 40 to some second rotational speed R2 that varies depending on a variety of factors, including load mass. At 68, after the application of known energy, the coast time t it takes for the motor 40 to return to the first rotational speed R1 is determined. Steps 64-68 can be performed once to determine a single coast time t, or multiple times to determine multiple coast times for the load, wherein an average coast time can be determined from the multiple coast times.

At 70, a load amount is determined from the coast time t from 68. The determination can be made using well known algorithms based on the values for t, known added energy, and the first rotation speed R1, or from lookup tables with empirical correspondence values that have been predetermined. The determination may be made by the controller 54 and rendered automatically when the first rotation speed R1 is achieved after the addition of the known amount of energy. In one example, the load amount can be determined from the average coast time. In another example, rather than determining an average coast time, steps 64-70 can be performed multiple times to determine multiple load amounts for the load, and an average load amount can be determined from the multiple load amounts. The determined load amount may be quantitative or qualitative. One example of quantitative load amount is the mass or weight of the load. Examples of qualitative load amounts are extra-small, small, medium, large, or extra-large. Such values can be determined from the value of the load size determination. In one embodiment, the qualitative load amounts may be based on ranges of quantitative load amounts. For illustrative purposes only, a small load may correlate to laundry weighing 2 kg or less, a medium load may range from 2-5 kg, and a large load may be over 5 kg.

At 72, the controller 54 may alter the cycle of operation based on the load amount determined at 70. For example, treating chemistry amount, cycle phase time and/or rotational speed may be altered at 72 based on the determined load amount.

After the end 74 of the method 60, a treating cycle may commence based on the determined load amount.

The invention described herein provides an improved method for load amount detection. The method 60 based on predefined known added energy may mitigate machine variation effects. Previous load amount detection methods were calibrated by measuring the time required to accelerate the motor from a first fixed speed, such as 300 rpm, to a second fixed speed, such as 500 rpm with an empty drum, and stored the time as being a baseline for a 0 kg load. However, these fixed speeds are too fast for light, dry garments and may actually throw garments out of the drum 30, and the calibration method did not account for the effects of temperature on this type of inertia-based load sensing. In the method according to the present invention, machine variation is compensated for by calibrating the laundry treating appliance 10 with a known load amount, such as an empty drum 30, following the method 60. The controller 54 may store values for voltage, current, rpms, and coast time for the known load amount. All subsequent operations of the laundry treating appliance 10 through the method 60 can be compared to the stored values from the calibration, which will account for variation is machine friction, motor torque, motor winding resistance, bearing alignment, capacitance, and temperature, among other factors.

The method 60 based on predefined known added energy may eliminate effects of temperature on load amount detection. Temperature changes effect motor performance and can lead to false or incorrect load amount detection if not taken into account. Previous load amount detection methods did not compensate for temperature, or used costly thermistors. In the method according to the present invention, changes in temperature are compensated for by the calibration discussed above. The relationship between the change in voltage and current from the calibration values for voltage and current closely follows the temperature change from the calibration value for temperature. By estimating the differential temperature, temperature changes can be compensated for in the load amount determination.

The method 60 based on predefined known added energy may adjust for motor stall. Previous load amount detection methods did not compensate for motor stall, or simply shut the motor off if a temperature of the motor exceeded a threshold value and would not start again until the motor cooled. In the method 60 according to the present invention, motor stall may be compensated for by using a current sensor to detect if the motor 40 is stalling. If the motor 40 stalls, the motor 40 may be stopped, and additional treating liquid may be added to the drum 30, which will "float" more of the load and ease the load on the clothes mover 38.

The method 60 based on predefined known added energy may adjust to appliance aging. Previous load amount detection methods did not compensate for aging of the laundry treating appliance, and friction between moving components of the laundry treating appliance may change over time, typically (but not always) decreasing, leading to false or incorrect load amount detection. In the method according to the present invention, changes in friction are compensated for by the calibration discussed above. The relationship between the change in coast time from the calibration value for coast time closely follows the change in machine friction. By estimating the change in machine friction, frictional changes can be compensated for in the load amount determination.

The method 60 based on predefined known added energy may detect the fabric type and adjust the cycle of operation accordingly. Using the load amount determined with the method 60, the fabric type can be determined by measuring the absorption of the load since absorption is a function of fabric type. For example, cotton is more absorptive than polyester. The absorption of the load can be determined from the amount of treating liquid supplied to the drum 30 and the fill level of the drum 30. Based on the fabric type, the controller 54 may alter the treating cycle.

The method 60 based on predefined known added energy may eliminate the loss of light garments caused by the spin phase of a cycle of operation. As discussed above for the calibration used by previous types of inertia-based load sensing, the fixed speeds used by previous methods are too fast for light, dry garments and may actually throw garments out of the drum 30. In the method according to the present invention, much lower motor speeds can be used to obtain an accurate estimate of load amount. For example, the second rotational speed R2 may be closer to 160 rpm rather than 500 rpm for a given load amount.

The method 60 based on predefined known added energy may compensate for off-balance load effect. A first coast time t can be determined following the method 60. After a period of time, a second coast time t can be determined. Off-balance loads lose energy, so there is a slower acceleration to the second rotational speed R2 for an off-balance load, resulting quicker deceleration and a smaller coast time. Therefore, if the second coast time t is less than the first coast time t, an off-balance condition can be determined and action can be taken to correct the off-balance condition.

The method 60 based on predefined known added energy may reduce current sensing error. Any current sensing performed in the method 60 may be delayed for a period of time after voltage is applied to the motor 40 to avoid variation in inrush current caused by inductance and rotor location relative to the stator, among other things. The current sensing can include sensing differential current, based on the peak-to-peak frequency of the AC signal of the motor 40.

The method 60 based on predefined known added energy may reduce voltage sensing error. Any voltage sensing performed in the method 60 may be done with other analog/digital converter inputs shut off to minimize variation in the sensed voltage. Further, the clock of the microprocessor in the controller 54 can be trimmed to eliminate variation caused by the microprocessor being out of sync with the voltage supply frequency. Voltage may be sensed over a period of time sufficient to average any variation, which allows for a more accurate estimate of the energy inputted to the motor 40. Any voltage sensing performed in the method 60 may further be performed during a spin phase of the treating cycle, rather than before or after a spin phase. The voltage sensing can include sensing differential voltage, based on the peak-to-peak frequency of the AC signal of the motor 40.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a laundry treating appliance having a controller and a rotatable drum defining a treating chamber for holding a laundry load for treatment according to an automatic cycle of operation and driven by a variable speed motor, the method comprising:

determining a first rotational speed of the variable speed motor;

applying a known amount of energy stored by the controller to the variable speed motor to accelerate the rotation of the drum;

removing the known amount of energy from the variable speed motor;

determining a coast time for the variable speed motor to return to the first rotational speed; and determining a load size of the laundry load within the treating chamber based on the known amount of energy and the determined coast time.

2. The method of claim 1 wherein the applying a known amount of energy to the motor and determining a coast time are repeated multiple times to determine multiple coast times.

3. The method of claim 2, further comprising determining an average coast time from the multiple determined coast times.

4. The method of claim 3 wherein determining the load size is based on the determined average coast time.

5. The method of claim 1, further comprising determining multiple load sizes for the laundry load.

6. The method of claim 5, further comprising determining an average load size from the multiple determined load sizes.

7. The method of claim 1 wherein determining the size of the laundry load comprises determining at least one of a quantitative and qualitative size of the laundry load.

8. The method of claim 7 wherein determining the qualitative size of the laundry load comprises determining a size from a predetermined subset of sizes.

9. The method of claim 8 wherein the predetermined subset of sizes comprises at least: extra-small, small, medium, large, and extra-large.

10. The method of claim 7 wherein determining the quantitative size of the laundry load comprises determining a value indicative of the weight of the laundry load.

11. The method of claim 7 wherein the qualitative size is based on the quantitative size.

12. The method according to claim 1 wherein the first rotational speed is zero revolutions per minute.

13. The method according to claim 1 wherein the first rotational speed is equal to a lowest speed detectable by the laundry treating appliance.

14. The method of claim 1 wherein the known amount of energy applied to the motor is determined by applying a given amount of voltage or current to the motor for a given amount of time.

15. The method of claim 1, further comprising altering the cycle of operation based on the determined load size.

16. The method of claim 15 wherein altering the cycle of operation comprises altering at least one of a treating chemistry amount, a cycle phase time, and a rotational speed of the treating chamber.

* * * * *